US010229569B1

(12) United States Patent
Adrain

(10) Patent No.: US 10,229,569 B1
(45) Date of Patent: Mar. 12, 2019

(54) BURGLAR DEFENSE SYSTEM

(71) Applicant: John B. Adrain, Frisco, TX (US)

(72) Inventor: John B. Adrain, Frisco, TX (US)

( * ) Notice: Subject to any disclaimer, the term of this patent is extended or adjusted under 35 U.S.C. 154(b) by 609 days.

(21) Appl. No.: 14/213,053

(22) Filed: Mar. 14, 2014

Related U.S. Application Data

(60) Provisional application No. 61/782,885, filed on Mar. 14, 2013.

(51) Int. Cl.
*G08B 15/02* (2006.01)

(52) U.S. Cl.
CPC ..... *G08B 15/02* (2013.01)

(58) Field of Classification Search
CPC .... G08B 15/00; G08B 15/02; G08B 13/1436; G08B 25/008
USPC .... 340/541, 545, 552, 554, 691, 692; 109/6, 109/20, 21, 29, 31, 35, 38
See application file for complete search history.

(56) References Cited

U.S. PATENT DOCUMENTS

| | | | | |
|---|---|---|---|---|
| 5,311,166 | A * | 5/1994 | Frye | G08B 15/00 109/20 |
| 6,288,643 | B1 * | 9/2001 | Lerg | B60C 23/06 340/539.1 |
| 2004/0113760 | A1 * | 6/2004 | Tanaka | B60R 25/014 340/426.1 |
| 2008/0111687 | A1 * | 5/2008 | Husmann | G08B 15/02 340/552 |
| 2011/0050418 | A1 * | 3/2011 | Hart | G08B 15/02 340/541 |
| 2012/0325127 | A1 | 12/2012 | Adrain | |

* cited by examiner

*Primary Examiner* — An T Nguyen
(74) *Attorney, Agent, or Firm* — Bodi Law LLC; Robert F. Bodi

(57) ABSTRACT

A burglar defense system for a structure having a dispensing system for a deterrence substance operably mounted to existing duct of a structure or the exterior wall of a structure; and a sensing system operably mounted to the system, wherein the dispensing system is operable to dispense the deterrence substance when an intrusion is sensed by the sensing system or when remotely activated.

18 Claims, 4 Drawing Sheets

BURGLAR DEFENSE SYSTEM

CROSS-REFERENCE TO RELATED APPLICATIONS

This application claims the benefit of U.S. Provisional Application No. 61/782,885, filed Mar. 14, 2013, the entire disclosure of which is incorporated herein by reference.

FIELD OF THE INVENTION

The present invention relates to security systems and, in particular, to systems that dispense substances to deter intrusion.

BACKGROUND

Certain structures need to be protected from access by unauthorized personnel. Examples of such structures include, but are not limited to, personal residences, vacation homes, garages, isolated buildings, cell tower sites, schools, businesses, prisons, and office buildings. Occasionally, a mere physical lock on the structure will not prevent an intruder from forcing access to the structure. Even an audible alarm may not be a sufficient deterrent if the structure is, for example, located in a remote area. For example, intruders enter onto a cell tower site, break into the site, and steal copper from the cell tower site. Other deterrence means are needed either to prevent the intruder from accessing the structure or doing much inside it once accessed, or to mark the intruder for later identification.

In many cases, the need for such protection has not been anticipated. For example, the epidemic of copper theft is a relatively new phenomenon. The need to protect important infrastructure from terrorist activities has only recently become apparent. As a result, many important resources are still protected only by simple doors.

BRIEF SUMMARY

This invention is a burglar defense system for a building structure having a distribution system operably coupled to the ventilation duct of a building structure; and an sensing system operably connected to the distribution system, wherein the dispensing system is operable to dispense a deterrence substance when an intrusion is sensed by the sensing system or when the sensing system is remotely activated.

In a further example embodiment, the burglar defense system comprises an enclosure with four walls, a bottom, and a top configured to dispense a deterrence substance. In a further example embodiment, the enclosure is mounted on the wall of a structure. In a further example embodiment, the enclosure is connected to the specific structure in need of protection by retrofitting existing infrastructure to support a deterrence substance delivered from the enclosure.

In a further example embodiment, the enclosure is made from aluminum. In a further example embodiment, the unit is weather tight, allowing air in yet keeping rain out.

In a further example embodiment, the enclosure is coated with coating material that maintains the internal temperature of the unit. In a further example embodiment, the coating material deflects heat from the unit.

In a further example embodiment, the deterrence substance comprises a member selected from the group including pepper spray (oleoresin *capsicum* spray), tear gas spray, ink, malodorous spray, lethal gas or spray, or a non-lethal incapacitating agent.

In a further example embodiment, the burglar defense system comprises a sensor. In a further example embodiment, the burglar defense system comprises an infrared motion sensor, microwave sensor, vibration sensor, or video sensor. In a further example embodiment, the burglar defense system can be triggered remotely by an output from another device, including but not limited to a computer, personal digital assistant ("PDA"), cellular telephone, and a remote control.

A further example embodiment includes a disabling mechanism, which disables emission of the deterrence substance once the disabling mechanism is activated by an authorized person. In a further example embodiment, the disabling mechanism includes a member selected from the group including, but not limited to, a key switch, a keypad, a thumb print reader, a voice print detector, an iris scanner, other biometric detector, a cellular telephone, a computer, a personal digital assistant, and a remote control.

A further example embodiment further includes a wired or wireless communication system for transmitting diagnostic information and/or audio and/or video captured at the structure. In a further example embodiment, the diagnostic information includes a member selected from the group including battery life, power supply, intrusion sensor status, and deterrence substance level. In a further example embodiment, communication system comprises an Internet protocol communication system, a Bluetooth communication system, or a cellular phone communication system.

In a further example embodiment, the burglar defense system comprises a warning system to alert an unauthorized person approaching the structure. In a further example embodiment, the warning is given as a verbal command from within the structure. In a further example embodiment, the warning is given as a warning tone from within the burglar defense system.

In a still further embodiment, the burglar defense system comprises a pepper spray fog system that can be mounted before or after a fan in a heating or air conditioning system. The system can be activated by sensors or a smart phone or via the internet. The system can also trigger the fan in the heating or air conditioning system to shut down or ventilate in various parts of the building to get the desired effects in response to an emergency or intruders. The system could also lock down various hall ways or rooms accordingly. The system could be centrally plumbed like a sprinkler system or each unit could have its own supply of pepper spray fog. The system could also disperse a dye in the fog so criminals can be found easier. Outdoor units would be placed in weather resistant enclosures and be able to disperse according to results and environmental conditions such as wind.

BRIEF DESCRIPTION OF THE DRAWINGS

The foregoing and other aspects of the examples will become apparent to those skilled in the art to which the examples relate upon reading the following description with reference to the accompanying drawings, in which.

DETAILED DESCRIPTION OF THE EXAMPLE EMBODIMENTS

Figure 1:
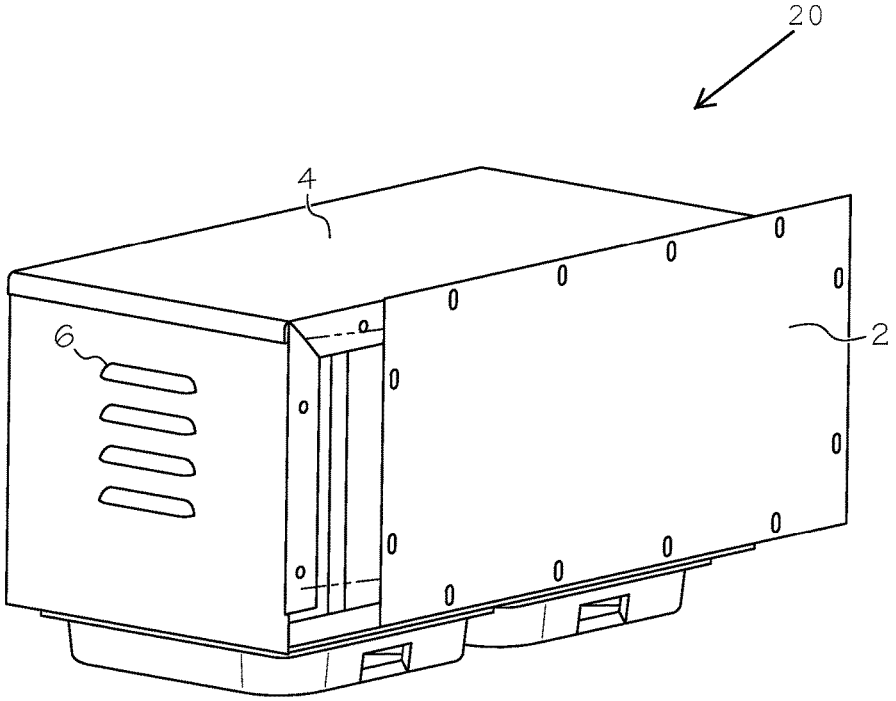
FIG. 1 is a perspective drawing of an enclosure with an embodiment of the burglar defense system with one wall detached from the back of the enclosure.

Example embodiments that incorporate one or more aspects of the example embodiments are described and illustrated in the drawings. These illustrated examples are not intended to be considered limitations on the examples. For example, one or more aspects of the examples can be utilized in other embodiments and even other types of devices. Moreover, certain terminology is used herein for convenience only and is not to be taken as a limitation on the embodiments.

U.S. Patent Publication No. 2012/0325127 ("Adrain"), incorporated by reference in its entirety herein, discloses an intrusion deterrence accessory device that dispenses substances to deter intrusion.

Figure 2:
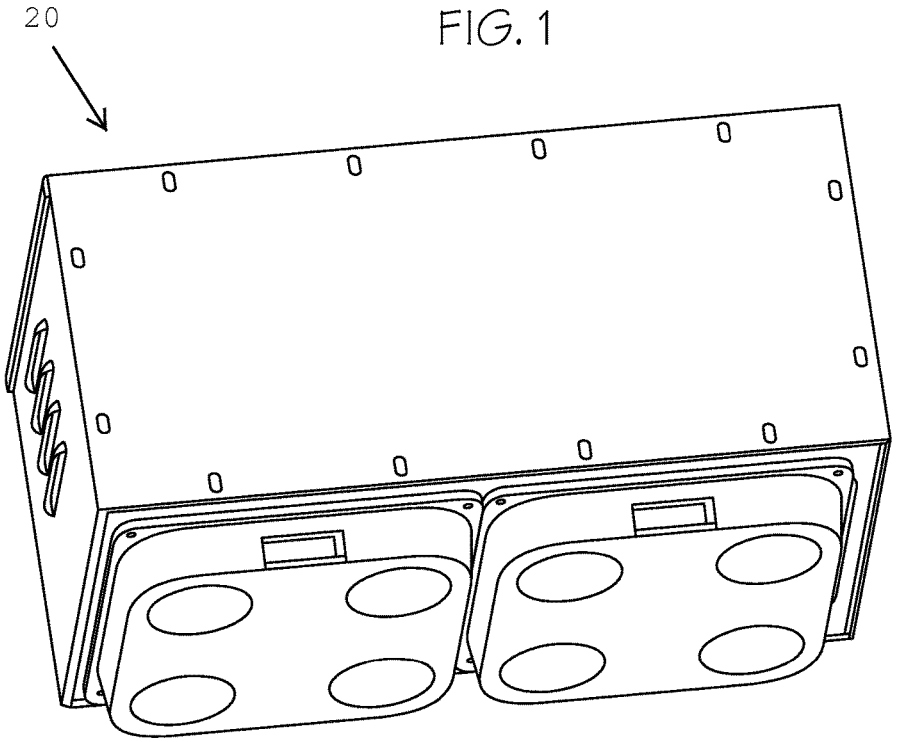
FIG. 2 is a perspective drawing of an enclosure with an embodiment of the burglar defense system.

FIGS. 1-2 show one example embodiment. The burglar defense system 20 includes a removable panel 2 for an enclosure 4 that allows access to the interior of the enclosure 4. The removable panel 2 may be secured to the enclosure 4 by a mechanism to prevent unauthorized access, such as, for example tamper-resistant bolts or screws. The enclosure 4 also includes vents 6 to allow for ventilation. The enclosure 4 may be coated with coating material that maintains the internal temperature of the unit. In a further example embodiment, the coating material may deflect heat from the enclosure.

The burglar defense system 20 can be powered by batteries or power can be derived from power mains. The power mains may power the system by line-voltage, directly, or through a step-down transformer, with a battery serving as backup. Battery power may be rechargeable, and provided in a tamper-proof housing, or the housing of the defense system 20 may be made tamper proof, or placed in a secure area to avoid tampering.

The burglar defense system 20 may be used indoor or may be used outdoors by retrofitting to tie in with existing infrastructure.

The burglar defense system 20 further includes a dispensing system configured to dispense a deterrence substance. The dispensing system may comprise various deterrence substances, included but not limited to, for example, pepper spray (oleoresin *capsicum* spray), tear gas spray, ink, malodorous spray, lethal gas or spray, or a non-lethal incapacitating agent.

The burglar defense system 20 further includes a sensing system configured to sense unauthorized intrusion. The sensing system may comprise a sensor or sensors, including but not limited to an infrared motion sensor, microwave sensors, vibration sensors, or video sensors.

Figure 7:
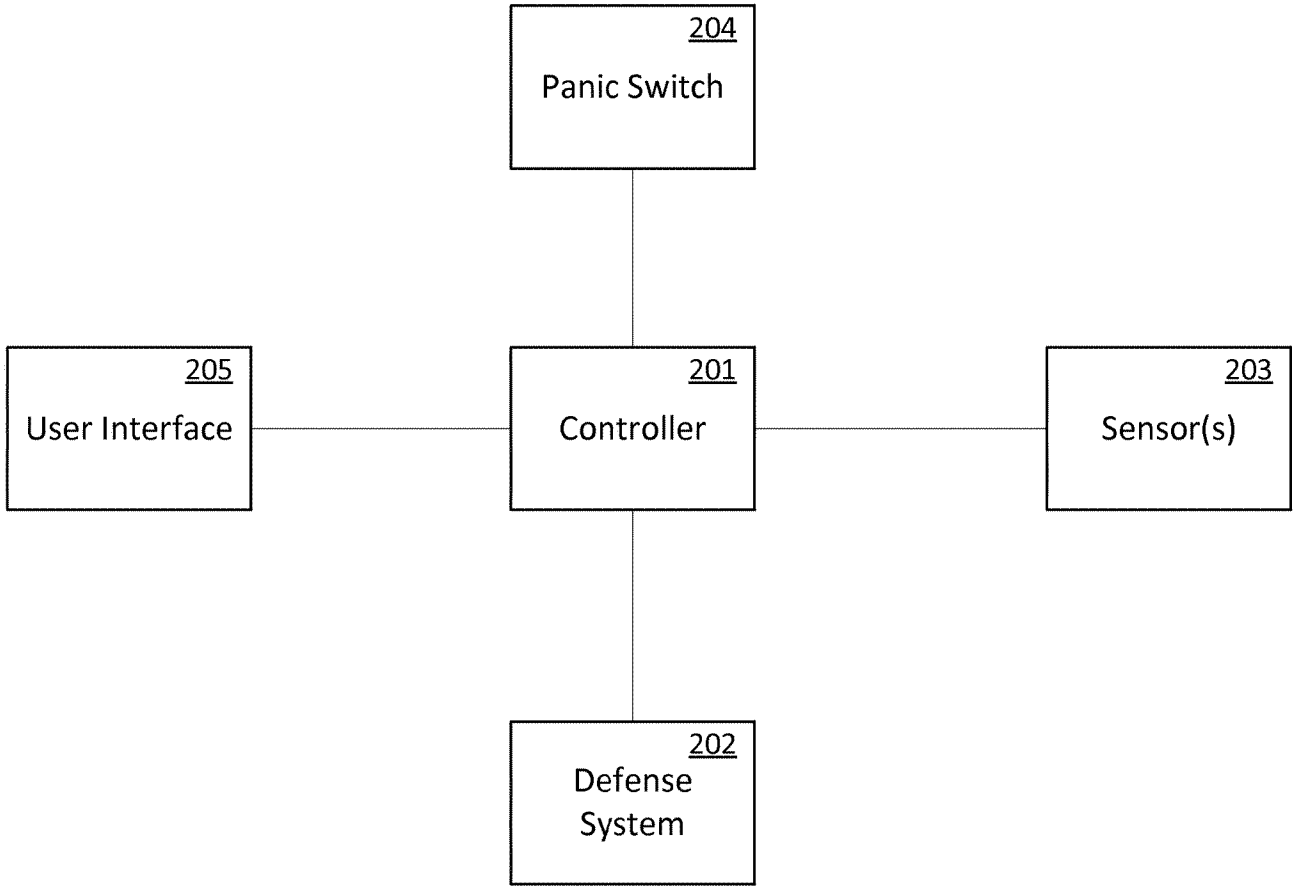
FIG. 7 is a block diagram showing an example sensing (control) system for controlling any of the example defense systems.

FIG. 7 provides an example of such a sensing system which can be used by any of the systems described herein, which can include a controller 201 with one or more sensors 203 connected to the controller 201, and a panic switch 204 connected to the controller 201. The controller is connected to the defense system 202 for actuating and monitoring the various components, which may include existing equipment such as water or heating systems, or fire suppression systems. Where a building may already have a central control system, controller 201 may utilize such a system by adding additional customized code for operating the defense system 202. The sensors 203 can include one or more heat sensors, infrared sensors, video sensors, audio sensors, smoke detectors, or other types of sensors, or may utilize already existing sensors of a fire or burglar system, for example. A user interface 205 can be provided for entering desired settings and displaying status information, for example. Any of the sensors 203, the panic switch 204 or the user interface 205, or any combination of these components, may be connected to the controller 201 in a wireless manner, such as by WiFi or Bluetooth, for example, and the panic switch and/or user interface could be implemented on a cell phone or tablet computer, for example.

Another embodiment of the burglar defense system 20 can include continuously emitting the deterrence substance for a short period of time once the dispensing system is activated, and then pulsing the dispensing system on and off periodically. For example, the initial period can be 2 seconds, 5 seconds, 10 seconds, 30 seconds, or some other length of time, with subsequent dispensing periods being 4 seconds on and 10 seconds off, for example. Any desired on and off times could be provided, and such periods may be programmable by the user via the user interface, for example. These values could be entered into the sensing system user interface by a user.

Figure 3:
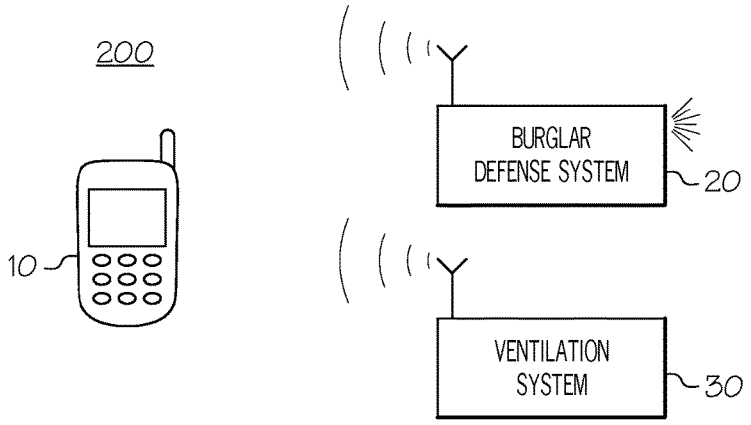
FIG. 3 is a schematic of an exemplary utilization of the burglar defense system in an embodiment.

In another embodiment shown in FIG. 3, the system 200 comprises a burglar defense system 20 that can wirelessly communicate with a remote device 10, such as a cell phone, PDA, tablet computer, laptop, panic button, etc., which can act as a "panic button" to set off the burglar defense system 20. Optionally, the ventilation system 30 of the building may also wirelessly communicate with the remote device 10 to increase or preferably decrease airflow in the building in response to setting a panic button.

Figure 4:
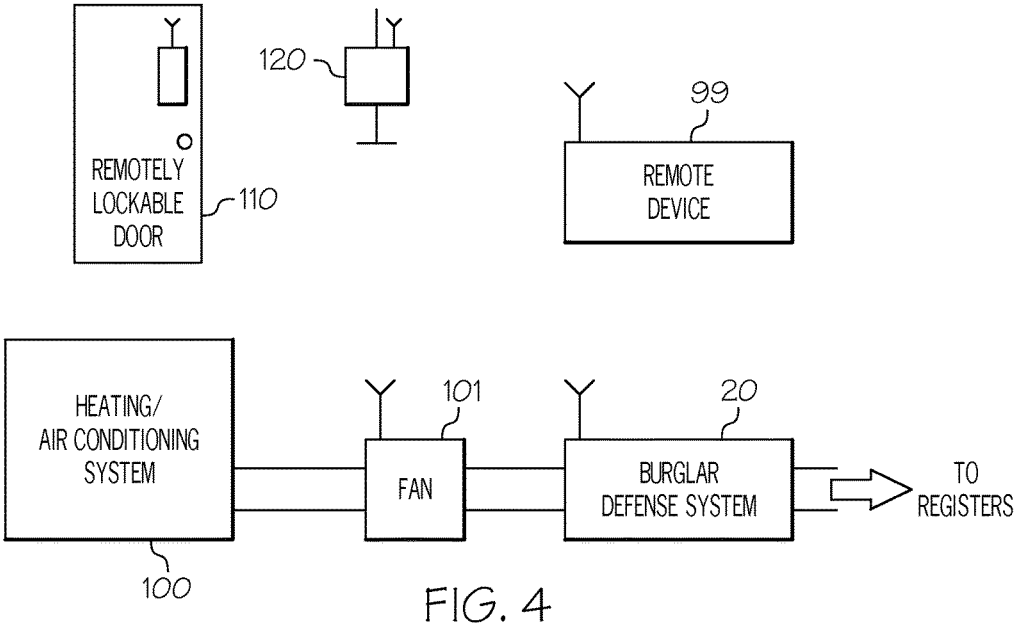
FIG. 4 is a schematic of another exemplary utilization of the burglar defense system in another embodiment.

In a still further embodiment, an example of which is shown in FIG. 4, the system 300 comprises a burglar defense system 20 (such as a pepper spray fog system) that can be mounted before or after a fan 101 in a heating or air conditioning system 100 for dispersal into the building. The system 300 can be wirelessly activated by sensors or a smart phone or via the internet or any other remote device 99, such as by using a sensor system such as shown in FIG. 7, for example. The system 300 can also trigger the fan in the heating or air conditioning system to shut down or ventilate the various parts of the building to get the desired effects in response to an emergency or intruders. The system 300 could also lock down various hall ways or rooms accordingly, such as by using a remotely lockable door 110. The system 300 could be centrally plumbed to a sprinkler system 120 or each sprinkler head unit could have its own supply of pepper spray fog. The system 300 could also disperse a dye in the fog so criminals can be found easier. Outdoor burglar defense systems 20 would be placed in weather resistant and secure enclosures and configured to be able to disperse according to results and environmental conditions such as wind, snow and rain.

Figure 5:
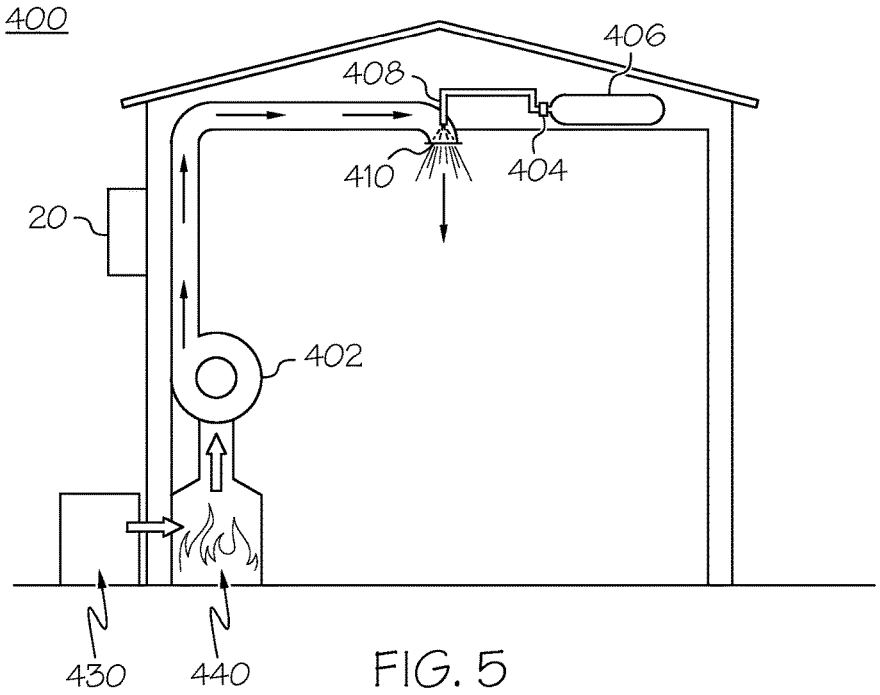
FIG. 5 is an illustration of an exemplary utilization of an embodiment of the burglar defense system in a building structure.

Another example embodiment shown in FIG. 5 can include the burglar defense system 20 being retrofitted to dispense the deterrence substance through existing ductwork within a structure 400. For example, the system may be connected to a pre-existing heating system 440, or any ventilation, or air conditioning system within the structure to deliver the deterrence substance within the structure. As a further example, the dispensing system of the burglar defense system 20 may disperse the deterrence substance from storage container 406 storing the agent through nozzle 408 into existing air vent 410 upon being triggered by the sensing system (such as shown in FIG. 7) that there has been unauthorized access or intrusion, which may be detected by motion sensor, video, infrared, etc. The sensing system is operably connected to valve 404 which may be actuated to disperse burglar defense system 20 the based on, but not limited to, a motion sensor, electrical sensor, and door or window sensor for detecting the opening or closing of the door or window, for example.

Figure 6:
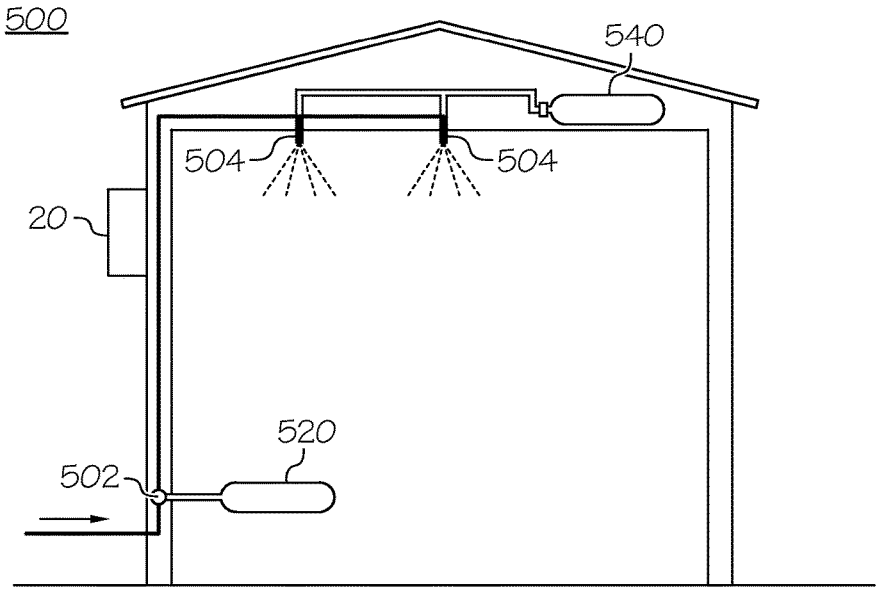
FIG. 6 is an illustration of another exemplary utilization of another embodiment of the burglar defense system in a building structure.

Another embodiment shown in FIG. 6 can include the burglar defense system 20 being retrofitted to dispense the deterrence substance through existing infrastructure. For example, the burglar defense system 20 can be retrofitted to dispense the deterrence substance through pipes connected to an existing sprinkler system 500. In a further example embodiment, the burglar defense system 20 may dispense the deterrence substance in conjunction with the sprinkler system 500 dispensing water. Another example embodiment can include several deterrence containers 520 and 540, in which the burglar defense system 20 can switch to a different container if the current one is empty. In a further embodiment, the deterrence substance contained in storage tanks 520 may be a similar or a different type of deterrence substance from the deterrence substance contained in storage tanks 540. This embodiment may allow the concentration of deterrence substance to be adjusted based on the amount of water dispensed through the existing sprinkler system. In a further example embodiment, the dispensing system of the burglar defense system 20 could be centrally plumbed to a main sprinkler head valve 502 of the sprinkler system or each sprinkler head valves 504 could disperse its own deterrence. The valves 502 and 504 may be actuated by, but not limited to, intrusion motion sensors such as door and window sensors or by heat sensors, and may utilize a sensor system such as shown in FIG. 7 to control the valves and other parts of the system.

Another example embodiment can allow the burglar defense system 20 to deliver the deterrence substance to particular rooms within the structure in need of protection. For example, by placing additional sensors within particular rooms, the burglar defense system 20 may be activated to deliver the deterrence substance to a single room within a structure, rather than delivering the deterrence substance throughout the entire structure. Sensors distributed throughout the building can be used to detect the intrusion and activate the system only where desired to respond to the intrusion. The system might monitor for gunshots or other events using the distributed sensors under control of a sensor control system such as shown in FIG. 7.

With either the outdoor or indoor burglar defense system 20 the propellant could be either separate or mixed in with existing materials. For example the distribution system could have a separate vessel or tank of compressed gas or air and a separate tank of deterrent substance. Or a concentrated agent could be mixed with water, which may be the water that would be used in a fire suppression system, for example, perhaps negating the need to bypass, divert, or shut off the water supply when activating the system.

Another example embodiment can include diagnostic monitoring of the burglar defense system 20, such as by using the system of FIG. 7. Diagnostic information can be transmitted to another location via a communication link, whether wired or wireless. Common communication links include, but are not limited to, TCP/IP, cellular telephone, Bluetooth, Wi-Fi, and LAN. Utilizing such common communication methods can allow the burglar defense system 20 to easily interface with existing equipment. Diagnostic information can include, but is not limited to, battery life, power supply, deterrence substance level, and sensor status. Once a deterrence substance container is empty, a diagnostic message can be sent by the burglar defense system 20 indicating a refill of the dispenser is needed.

Another example embodiment can include audio and/or video sensors that can record audio and/or video captured at the structure location, which may be used in a control system such as shown in FIG. 7. Additionally, such audio and/or video can be transmitted to another location via the communication link for display on a user device, for example.

The burglar defense system 20 may be triggered remotely by an output from another device, including but not limited to a computer, personal digital assistant ("PDA"), cellular telephone, and a remote control. For example, after a remote operator receives captured audio and/or video from the system and notices intruders near or in the structure, the operator can send a command via the Internet to activate the burglar defense system 20.

Another example embodiment can include a disabling mechanism to disable the dispenser, which allows authorized personnel to access the enclosure 4. Such a disabling mechanism can include, but is not limited to, a key switch, a keypad by which a code can be entered, a thumb print scanner, an iris scanner, a voice print detector, other biometric detector, and a remote control.

Another example embodiment can allow the burglar defense system 20 to warn an intruder of the imminent dispensing of the deterrence substance unless the intruder ceases the intrusion and leaves. Such a warning can be triggered by an intrusion sensor and be given prior to initiating the dispensing of the deterrence substance. Such a warning can be a pre-recorded audio command that is stored on a player inside the system, and is played via a speaker inside the enclosure. Such a warning can also be a visual message displayed on a screen on the enclosure 4.

Referring to the sensing system of FIG. 7, the panic switch 204 can be provided in any convenient location, such as on a wall or door, on a key fob, etc. This switch might be a lever, push button, pedal, etc. This switch could be activated using an application on a cell phone or tablet computer communicating with the controller 201 via Bluetooth, for example. A fob or other remote switch could likewise use wireless communication such as Bluetooth or WiFi.

The sensors 203 could monitor for temperature, motion, sound, breakage, body heat, or a voice command, for example, for deploying the device. For example, the controller could be programmed to monitor for a gunshot, or an improper intrusion or break-in, for example, and automatically and quickly activate the defense system. Alternatively, the panic switch 204 can be used for such purposes.

The controller 201 could be any commercially available computer or controller that is programmed to actuate the actuator upon activation of the switch 204 or detection of the desired conditions by the sensors 203. A controller of an existing system, such as a burglar alarm or fire detection or suppression system might be used with customized software installed. Such a controller will likely include a programmable processor and a memory for storing a program for monitoring the sensor input for activating the defense system upon the happening of the desired condition.

In some circumstances, the controller 201 might be bypassed entirely, such as where the panic switch 202 is directly connected to the defense system 202 for activation. Power for these components can be supplied by separate battery, or by tapping into a local power supply, for example.

As will be appreciated by one of skill in the art, the example sensor system and controller of FIG. 7 may be actualized as, or may generally utilize, a method, system, computer program product, or a combination of the foregoing. Accordingly, any of the embodiments of this sensor system may take the form of an entirely hardware embodiment, an entirely software embodiment (including firmware, resident software, microcode, etc.) for execution on hardware, or an embodiment combining software and hardware aspects that may generally be referred to herein as a "system." Furthermore, any of the embodiments may take the form of a computer program product on a computer-usable storage medium having computer-usable program code embodied in the medium.

Any suitable computer usable (computer readable) medium may be utilized for storing the software. The computer usable or computer readable medium may be, for example but not limited to, an electronic, magnetic, optical, electromagnetic, infrared, or semiconductor system, apparatus, device, or propagation medium. More specific examples (a non-exhaustive list) of the computer readable medium would include the following: an electrical connection having one or more wires; a tangible medium such as a portable computer diskette, a hard disk, a random access memory (RAM), a read-only memory (ROM), an erasable programmable read-only memory (EPROM or Flash memory), a compact disc read-only memory (CDROM), or other tangible optical or magnetic storage device; or transmission media such as those supporting the Internet or an intranet. Note that the computer usable or computer readable medium could even include another medium from which the program can be electronically captured, via, for instance, optical or magnetic scanning for example, then compiled, interpreted, or otherwise processed in a suitable manner, if necessary, and then stored in a computer memory of any acceptable type.

In the context of this document, a computer usable or computer readable medium may be any medium that can contain, store, communicate, propagate, or transport the program for use by, or in connection with, the instruction execution system, platform, apparatus, or device, which can include any suitable computer (or computer system) including one or more programmable or dedicated processor/controller(s). The computer usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, radio frequency (RF) or other means.

Computer program code for carrying out operations of the sensor system may be written by conventional means using any computer language, including but not limited to, an interpreted or event driven language such as BASIC, Lisp, VBA, or VBScript, or a GUI embodiment such as visual basic, a compiled programming language such as FORTRAN, COBOL, or Pascal, an object oriented, scripted or unscripted programming language such as Java, JavaScript, Perl, Smalltalk, C++, Object Pascal, or the like, artificial intelligence languages such as Prolog, a real-time embedded language such as Ada, or even more direct or simplified programming using ladder logic, an Assembler language, or directly programming using an appropriate machine language.

The software to be executed on the processor of the controller comprises computer program instructions that are executed by being provided to an executing device or component, which can include a processor of a general purpose computer, a special purpose computer or controller, or other programmable data processing apparatus or component, such that the instructions of the computer program, when executed, create means for implementing the functions/acts specified in this application. Hence, the computer program instructions are used to cause a series of operations to be performed on the executing device or component, or other programmable apparatus to produce a computer implemented process such that the instructions which execute on the computer or other programmable apparatus the steps for implementing the functions/acts specified in this disclosure. These steps or acts may be combined with operator or human implemented steps or acts and steps or acts provided by other components or apparatuses in order to carry out any number of example embodiments of the invention.

These example embodiments can be used to protect structures from intrusion. Examples of such structures include, but are not limited to, personal residences, vacation homes, garages, isolated buildings, cell tower sites, schools, businesses, prisons, and office buildings. The burglar defense system 20 can be installed and used indoors or outdoors on the structure to be protected. Generally, the sensor system monitors the various rooms and/or surroundings of the protected building using the sensors to detect intruders or assaults or other attacks, with the defense system being deployed to stop or mitigate the intrusion and/or attack by disabling the attacker/intruder. The defense system can be installed as part of original building construction, or retrofitted into an existing building, and it may be adapted to use existing systems such as fire detection or suppression systems, water distribution systems, or burglar alarms.

It should be evident that this disclosure is by way of example and that various changes may be made by adding, modifying, or eliminating details without departing from the fair scope of the teaching contained in this disclosure. The example embodiments are therefore not limited to particular details of this disclosure except to the extent that the following claims are necessarily so limited.

What is claimed is:

1. A burglar defense system comprising:

a sensing system including at least one sensor to sense unauthorized intrusion or event; and a dual-purpose distribution system connected to the sensing system to facilitate selective distribution of a deterrence substance and another non-deterrence substance through common distribution equipment configured to carry both the deterrence substance and the other non-deterrence substance, wherein the distribution system disperses the deterrence substance through the common distribution equipment when the sensing system is activated by the at least one sensor.

2. The burglar defense system according to claim 1, wherein the deterrence substance comprises a member selected from the group comprising pepper spray (oleoresin *capsicum* spray), tear gas spray, ink, malodorous spray, lethal gas or spray, or a non-lethal incapacitating agent.

3. The burglar defense system according to claim 1, wherein the sensing system comprises a member or combination of members selected from the group comprising an infrared motion sensor, microwave sensors, vibration sensors, and video sensors.

4. The burglar defense system according to claim 1, wherein the sensing system can be triggered remotely by an output from another device.

5. The burglar defense system according to claim 1, wherein the dual-purpose distribution system is configured to have at least one deterrence container, at least one valve, and at least one nozzle, wherein the distribution system is operable connect to the common distribution equipment including an existing duct of a building structure.

6. The burglar defense system according to claim 1, further comprising a disabling mechanism, which disables dispensing of the deterrence substance once the disabling mechanism is activated by an authorized person.

7. The burglar defense system according to claim 6, wherein the disabling mechanism comprises a member selected from the group comprising a key switch, a keypad, a thumb print reader, a voice print detector, an iris scanner, other biometric detector, a cellular telephone, and a remote control.

8. The burglar defense system according to claim 1, further comprising a wired or wirelesses communication system for transmitting diagnostic information and/or audio and/or video.

9. The burglar defense system according to claim 8, wherein the diagnostic information comprises a member selected from the group comprising battery life, power supply, intrusion sensor status, and deterrence substance level.

10. The burglar defense system according to claim 8, wherein the wireless communication system comprises an Internet Protocol communication system, a Bluetooth communication system, or a cellular telephone communication system.

11. The burglar defense system according to claim 1, further comprising a warning device in communication with the sensing system and operable to warn a user of an unauthorized person.

12. The burglar defense system according to claim 11, wherein the user is warned by the warning device through issuance of a verbal command, a text message to a mobile device, or an email.

13. A burglar defense system comprising:

a distribution system operably connected with an existing building distribution system and configured to serve a dual purpose;

a deterrence substance operably coupled to the distribution system;

another non-deterrence substance operably coupled to the distribution system, such that both said deterrence substance and said non-deterrence substance can be transported through common components of the existing building distribution equipment; and a sensing system including at least one wireless transmitter to wirelessly connect to at least one desired remote device in the building, wherein the sensing system outputs information to trigger the deterrence substance to disperse into the building upon sensing an emergency or intruder.

14. The burglar defense system according to claim 13, wherein the deterrence substance comprises a member selected from the group comprising pepper spray (oleoresin capsicum spray), tear gas spray, ink, malodorous spray, lethal gas or spray, or a non-lethal incapacitating agent.

15. The burglar defense system according to claim 13, wherein the deterrence substance is centrally plumbed to a sprinkler system of the building.

16. The burglar defense system according to claim 13, wherein the another non-deterrence substance is water or treated air.

17. A burglar defense system comprising:

a distribution system connected with existing building distribution equipment including at least one nozzle, wherein said distribution system is connected to a source of a deterrence substance and a source of non-deterrence substance, such that both said deterrence substance and said non-deterrence substance can be independently dispersed using the same at least one nozzle; and a sensing system including at least one sensor to sense unauthorized intrusion or event, wherein the sensing system triggers the distribution system to disperse the deterrence substance into the building using the same at least one nozzle upon sensing an emergency or intruder.

18. A method of providing burglar defense, comprising:

installing a retrofit burglar defense system by using a distribution system that already exists in a home to distribute a non-deterrence substance, wherein said burglar defense system includes a sensing system operably configured to sense unauthorized intrusion or event, and a source of a deterrence substance;

detecting an emergency or an intruder using the sensing system; and dispersing the deterrence substance through the distribution system that already exists in the home.

* * * * *